US008313340B2

(12) United States Patent
Krueger et al.

(10) Patent No.: US 8,313,340 B2
(45) **Date of Patent: *Nov. 20, 2012**

(54) CONNECTOR BACK SHELLS HAVING A PLURALITY OF CABLE EXIT ANGLES

(75) Inventors: Gordon Krueger, Nipomo, CA (US); Ezra Phillips, Cambria, CA (US)

(73) Assignee: Joslyn Sunbank Company LLC, Paso Robles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/199,214

(22) Filed: Aug. 23, 2011

(65) Prior Publication Data

US 2011/0312209 A1 Dec. 22, 2011

Related U.S. Application Data

(63) Continuation of application No. 12/653,807, filed on Dec. 18, 2009, now Pat. No. 8,025,525.

(60) Provisional application No. 61/203,250, filed on Dec. 19, 2008.

(51) Int. Cl.
*H01R 13/56* (2006.01)

(52) U.S. Cl. ..... 439/446; 439/471

(58) Field of Classification Search ..... 439/446, 439/471–472

See application file for complete search history.

(56) References Cited

U.S. PATENT DOCUMENTS

| | | | | |
|---|---|---|---|---|
| 3,781,765 | A * | 12/1973 | Schleicher | 439/472 |
| 5,178,559 | A * | 1/1993 | Mello | 439/472 |
| 5,358,429 | A | 10/1994 | Mina | |
| 5,975,942 | A * | 11/1999 | Roush et al. | 439/472 |
| 6,419,519 | B1 | 7/2002 | Young | |
| 7,249,964 | B1 * | 7/2007 | Hoffman et al. | 439/471 |
| 7,862,369 | B2 * | 1/2011 | Gimenes et al. | 439/446 |
| 2010/0159739 | A1 | 6/2010 | Krueger et al. | |

* cited by examiner

*Primary Examiner* — Truc Nguyen
(74) *Attorney, Agent, or Firm* — Lorimer Labs; D'Arcy H. Lorimer

(57) ABSTRACT

A wiring connector back shell having a plurality of cable exit angles is disclosed. The back shell has a single transition element with a number of holes fashioned therein, which allow a cable retaining device to be fastened thereto. The cable retaining device provides strain relief for the cable exiting the back shell, as well as determining the exit angle of the cable. The cable retaining device has integral pins which mate with hole patterns in the transition element, and are locked in place with a retaining collar. Alternatively, cable ties or tie wraps may be utilized to fasten the cable to the transition element. The system provides a high reliability, low mass method for cable back shells wherein cable exit angles are easily changed or chosen in the field.

20 Claims, 15 Drawing Sheets

CONNECTOR BACK SHELLS HAVING A PLURALITY OF CABLE EXIT ANGLES

REFERENCES TO PRIOR APPLICATIONS

This application is a continuation of non-provisional application, application Ser. No. 12/653,807, filed Dec. 18, 2009, now U.S. Pat. No. 8,025,525 entitled CONNECTOR BACKSHELLS HAVING A PLURALITY OF CABLE EXIT ANGLES, which is related to provisional application, reference No. 61/203,250, filed Dec. 19, 2008, entitled CONNECTOR BACKSHELLS HAVING A PLURALITY OF CABLE EXIT ANGLES, and claims benefit thereof. The aforementioned applications are herein incorporated by reference in their entirety.

BACKGROUND OF THE INVENTION

1. Field of the Invention

The invention relates to the design and structure of electrical connectors. More specifically, the invention relates to connector back shell designs having the ability to provide a number of cable exit angles and cable strain relief with a single set of components.

2. Description of the Related Art

A back shell is a device used in wire interconnect assemblies to transition from a plurality of insulated conductors (a plurality of wires or cable) to an electrical connector. The electrical connector will have conductive devices, usually in the form of pins or sockets, to which each of the conductors from the cable is terminated. The pins or sockets are held in a specific geometric arrangement within the shell of the connector, in order to mate with a matching connector having a similar arrangement of conductive pins or sockets. The wire from each of the conductors in the cable is attached to the pins or sockets in the electrical connector via soldering, crimping, or welding. These means of attachment can be subject to breakage if stresses from the wire cable are transmitted to the attachment points. In most cases, the back shell will provide some means for securing the wires or cable such that any forces acting upon the wires or cable will not be imposed on the wire connections and at the end of the wires. This is referred to as "strain relief" and is an important function performed by the back shell. In many cases this function is performed by either saddle clamps or banding platforms to accommodate either metallic or plastic bands. Another important function of the back shell is to direct the wire cable in a particular direction as it exits the connector. Typically, this is done with a short section of hollow conduit through which the cable is inserted. These are often manufactured with a fixed orientation such as straight (0 degrees), 45 degrees, or 90 degrees, and are an integral part of the back shell construction. One problem experienced by connector users is that once a cable is terminated into a particular connector and back shell orientation, changing that orientation during assembly in the field can be difficult. Even if the connector design allows multiple back shell orientations to be utilized without re-terminating the cable, the user still has to purchase and stock many back shell components for this purpose, which can be expensive. It would be desirable to have a back shell design that allows a plurality of cable exit angles with a single set of components that are an integral part of the back shell.

One such design is currently available which incorporates a means to overcome this problem. U.S. Pat. No. 6,419,519 discloses a design where the wire securing mechanism is at the end of dual arms that swing or pivot to adjust to different angular increments. Hardware then secures the assembly in place. Whilst this method meets the requirement of being able to accommodate multiple orientations of wire containment with a single back shell, it is burdened with multiple screws and hardware components, each requiring adjustment, and each having the ability to come loose becoming FOD (Foreign Object Debris) in high stress and/or critical applications. The design is also complex, and adjustment of cable direction may be difficult if the connector is terminated and there is no access to all the adjustment mechanisms.

What is needed is a more reliable, simple back shell design that provides appropriate strain relief while allowing a plurality of cable exit angles with a single set of components integrated into the back shell.

SUMMARY OF THE INVENTION

It is an object of the present invention to provide a connector back shell, said connector back shell operative to provide support for a wiring cable attached to a wiring connector, the connector back shell including a forward section having a hollow cylindrical shape, the cylindrical shape defining a first axis, the forward section operative to couple the connector back shell to the wiring connector; a transitional element, the transitional element comprising a plate having a first terminating straight edge, the first terminating straight edge positioned approximately parallel to the first axis, the plate having a second terminating straight edge, the second terminating straight edge positioned approximately perpendicular to the first terminating straight edge; a connecting element, the connecting element operative to rigidly couple the transitional element to the forward section, the connecting element rigidly fixed to a portion of the second terminating straight edge of the plate; and a cable retaining device, the cable retaining device attached to the plate of the transitional element, the cable retaining device operative to position the wiring cable relative to a first angle.

It is an object of the present invention to provide a connector back shell, said connector back shell operative to provide support for a wiring cable attached to a wiring connector, the connector back shell including a forward section having a hollow cylindrical shape, the cylindrical shape defining a first axis, the forward section operative to couple the connector back shell to the wiring connector; a transitional element, the transitional element comprising a plate having a first terminating straight edge, the first terminating straight edge positioned approximately parallel to the first axis, the plate having a second terminating straight edge, the second terminating straight edge positioned approximately perpendicular to the first straight edge, the plate of the transitional element having a plurality of holes fashioned therein, the plurality of holes located in a pattern, the pattern symmetric about a second axis, the second axis defined by bisection of a second angle formed by the first and second straight edges of the plate; a connecting element, the connecting element operative to rigidly couple the transitional element to the forward section, the connecting element rigidly fixed to a portion of the second terminating straight edge of the plate; and a cable retaining device, the cable retaining device attached to the plate of the transitional element, the cable retaining device operative to position the wiring cable relative to a first angle.

BRIEF DESCRIPTION OF THE DRAWINGS

The present invention will be better understood when consideration is given to the following detailed description thereof Such description makes reference to the annexed drawings, wherein.

DETAILED DESCRIPTION OF THE PREFERRED EMBODIMENTS

Figure 1A:
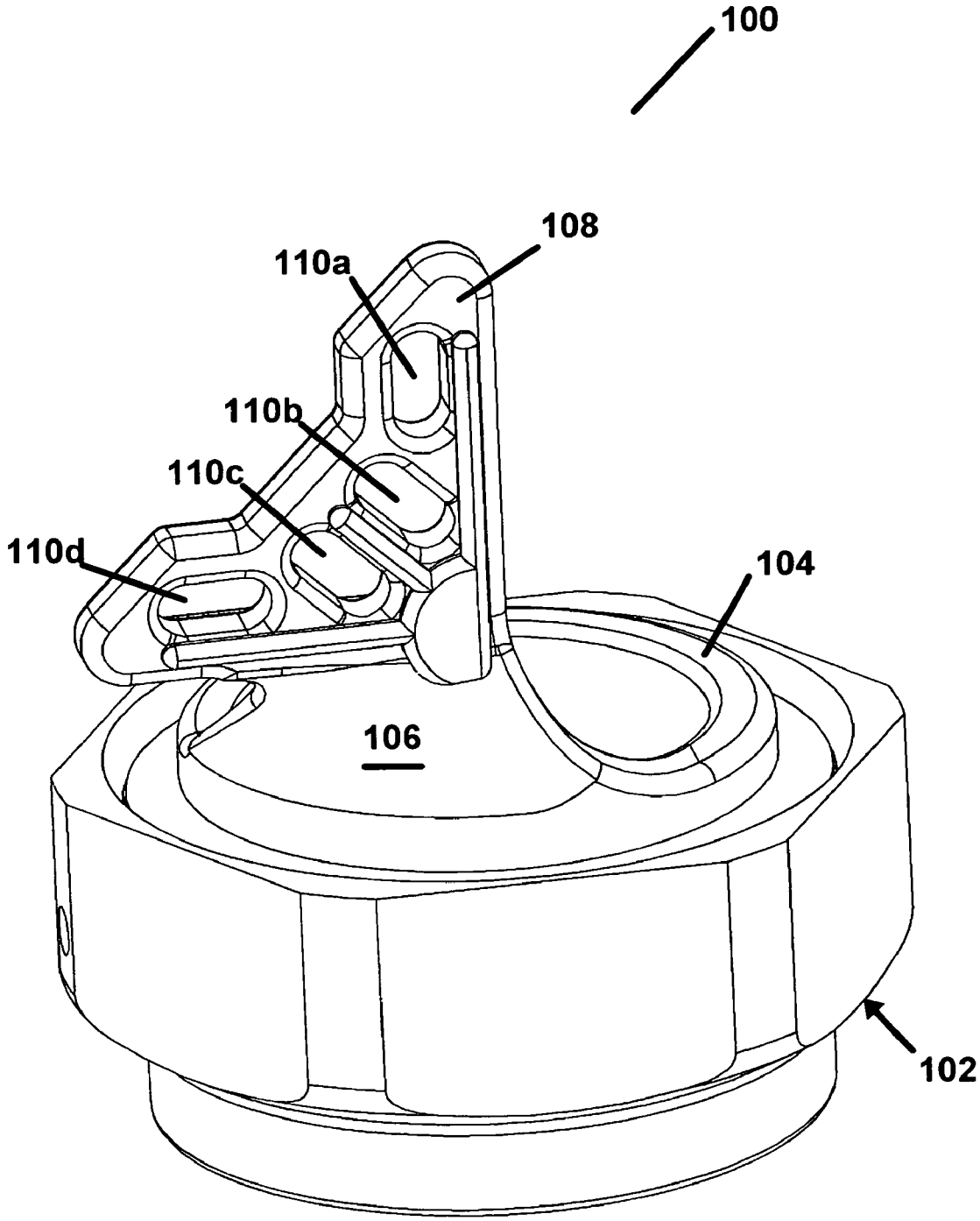
FIGS. 1*a* and 1*b* are isometric views of back shells employing a single transitional element, in accordance with an embodiment of the present invention.
Figure 1B:
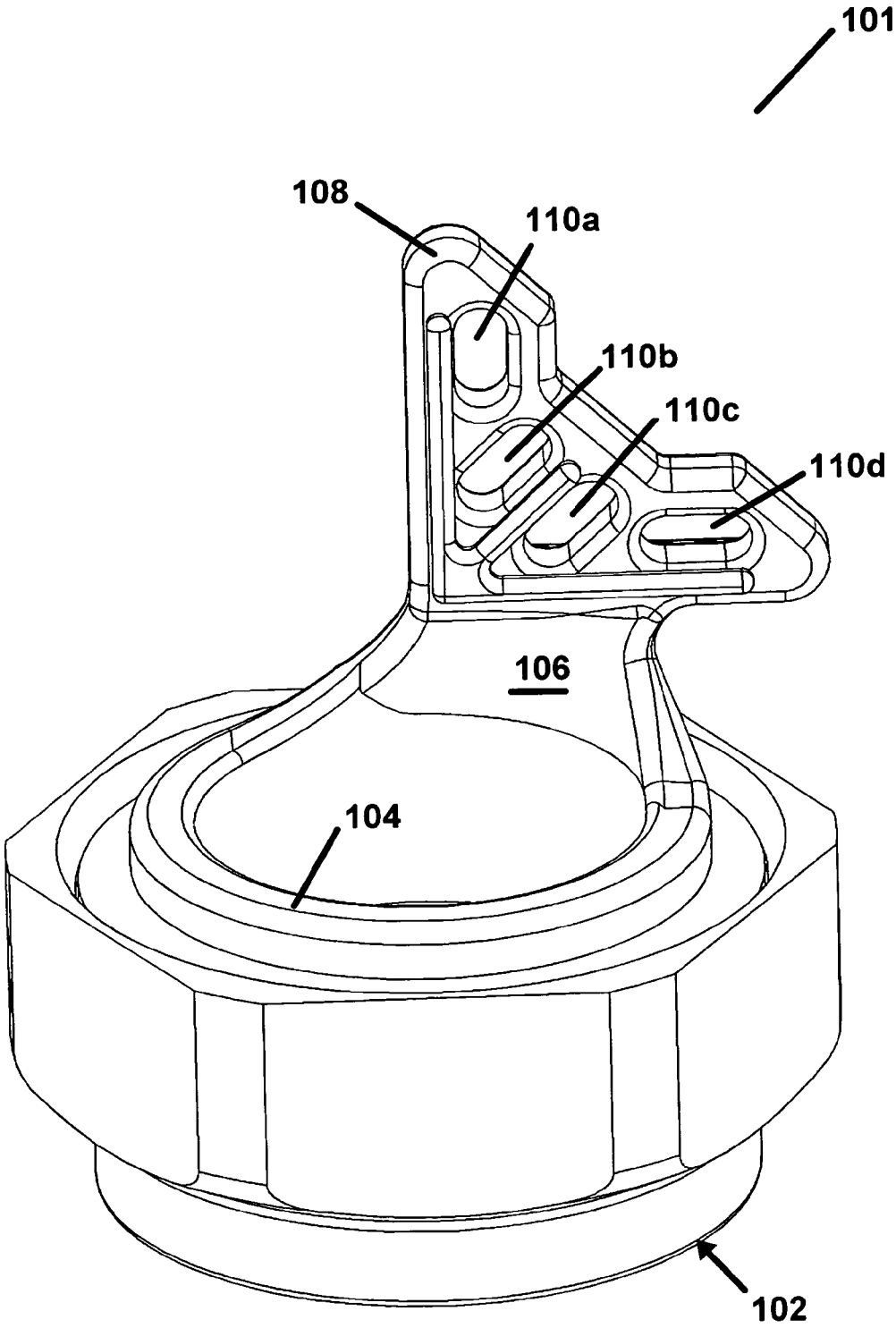

FIGS. 1*a* and 1*b* are isometric views 100, 101 of back shells 102 employing a single transitional element 108, in accordance with an embodiment of the present invention. These embodiments are improvements over back shells having two transitional elements (as for example, are disclosed in U.S. Pat. No. 6,419,519) due to simplicity of design and manufacture. This simplicity results in back shells of lower weight and reduced number of moving parts. Both features are important in aerospace and aircraft applications. Back shell 102 comprises a cylindrically shaped forward section 104, which supports transitional element 108 via connecting element 106. Transitional element 108 has a number of "elongated" holes 110*a*-110*d* fashioned therein. An elongated hole is one in which the length is greater than the width. These elongated holes 110 provide attachment points for a cable retaining device, which provides strain relief and fixes the direction of the wire cable exiting the back shell. Back shell 102 also comprises a threaded hexagonal component (shown) that revolves around forward section 104, which is utilized to couple back shell 102 to the wiring connector (not shown). The wiring connector contains an array of pins or sockets to which the individual conductors within the wire cable are attached (not shown).

Figure 1D:
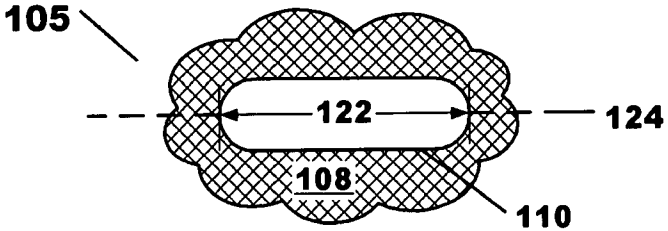
FIG. 1*d* is an expanded view of the elongated holes 110 of FIG. 1*c*, in accordance with an embodiment of the present invention.
Figure 1C:
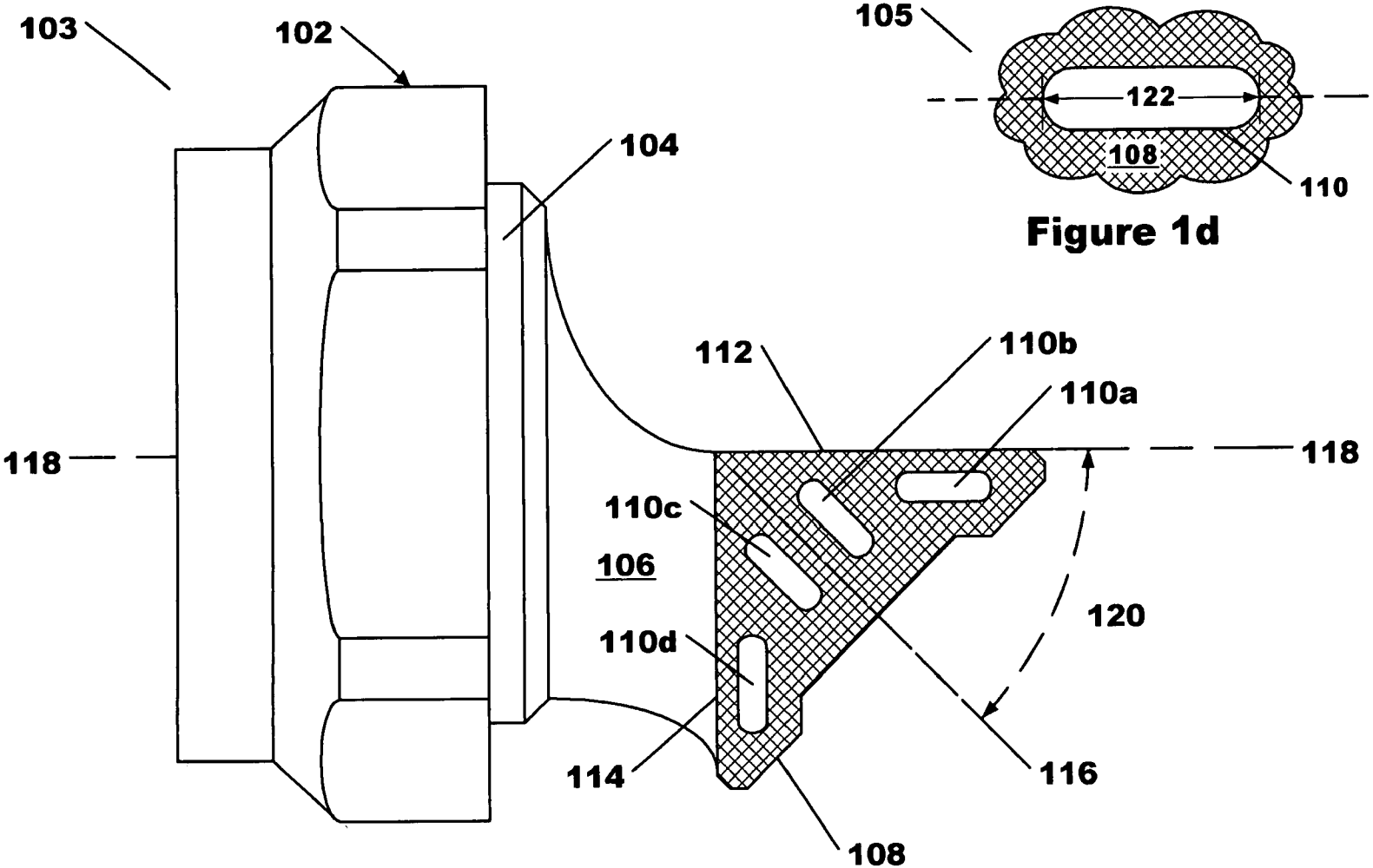
FIG. 1 c is a side view of the back shells of FIGS. 1*a* and 1*b*, in accordance with an embodiment of the present invention.

FIG. 1*c* is a side view 103 of the back shells 102 of FIGS. 1*a* and 1*b*, in accordance with an embodiment of the present invention. Transitional element 108 is cross hatched for clarification of its geometric boundaries and properties. Cylindrically shaped forward section 104 defines an axis of symmetry 118 through the center of the back shell 102. Transitional element is bounded by two orthogonal edges 112 and 114. Edge 112 is parallel to axis 118. Edge 114 is orthogonal to edge 112 (and axis 118), and provides the connection interface to connecting element 106. Angle 120, defined by axis 116, resides within the angle formed by the intersection of edges 112 and 114, and ranges from 0 to 90 degrees. Preferably, angle 120 bisects the angle between the angle formed by the intersection of edges 112 and 114, and is approximately 45 degrees. There are a number of "elongated" holes or ports fashioned within transitional element 108, whose purpose is to provide attachment locations for the cable retaining device. An elongated hole is one having a length greater than its width. The embodiments of FIGS. 1*a*-*c* are designed primarily for tie wraps, cable ties, or "zip" ties, but can be used with cable retaining devices having fixed pins that extend through one or more holes 110, such as those shown below in FIGS. 3*a*-*e*.

The elongated holes 110 placed within transitional element 108 have a specific geometric orientation. Elongated hole 110*a* is placed with its longest dimension parallel to edge 112 or axis 118. Elongated hole 110*d* is placed with its longest dimension parallel to edge 114, or perpendicular to edge 112. Elongated holes 110*b,c* are placed with their longest dimension parallel to axis 116. FIG. 1*d* is an expanded view 105 of the elongated holes 110 of FIG. 1*c*. The length 122 of hole 110 is greater than the width, with axis 124 is parallel to the direction of the longest dimension.

Figure 2A:
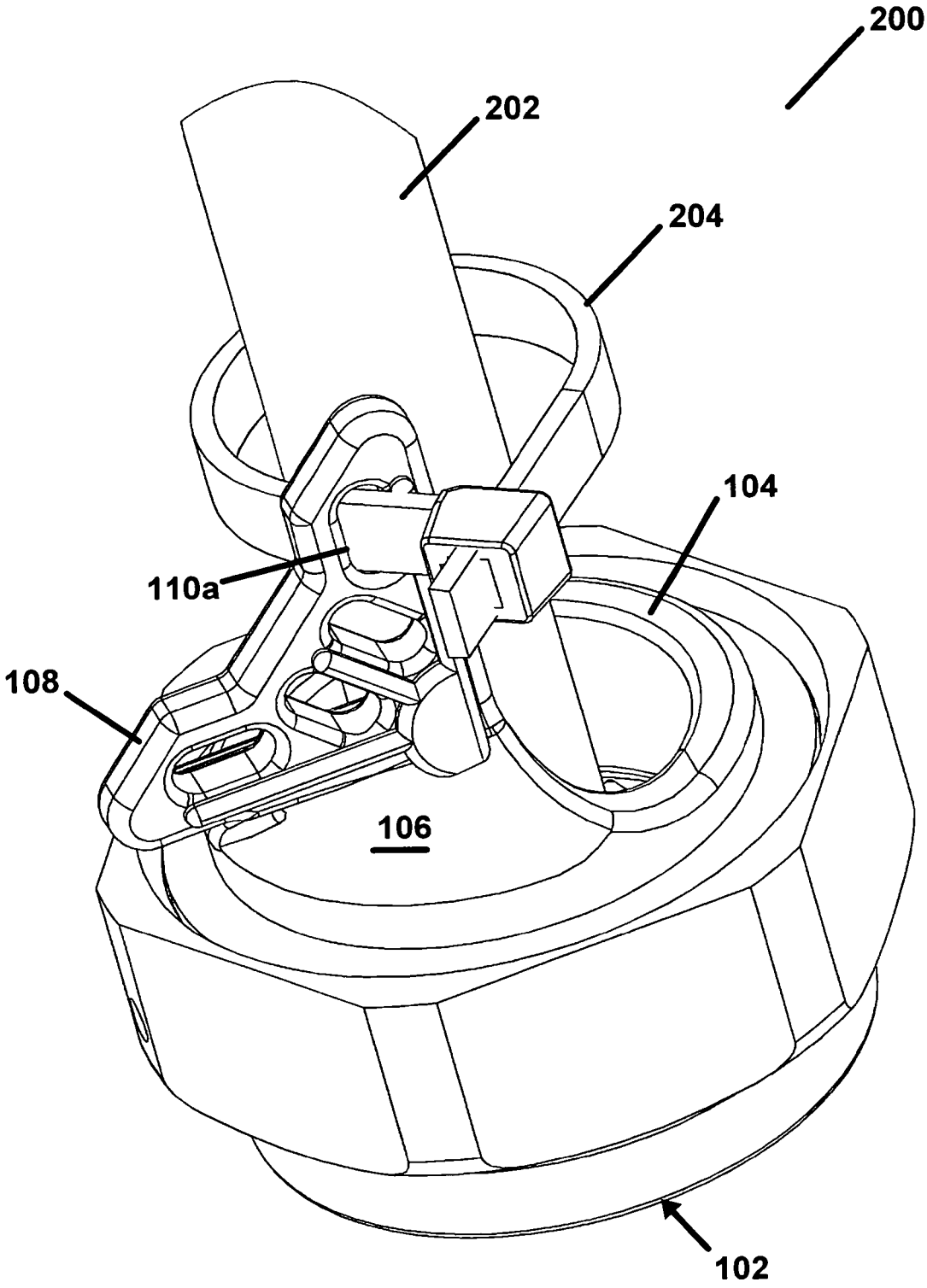
FIG. 2*a* is an isometric view of a back shell employing a tie wrap to maintain a cable exit angle of approximately 0 degrees, in accordance with an embodiment of the present invention.

FIG. 2*a* is an isometric view 200 of a back shell 102 employing a tie wrap 204 to maintain a cable exit angle of approximately 0 degrees, in accordance with an embodiment of the present invention. Cable 202 is held in place via tie wrap 204, which extends around cable 202 and through elongated hole 110*a*. The flat surface of the tie wrap, combined with the shape of the elongated hole, maintains the cable exit angle of approximately 0 degrees.

Figure 2B:
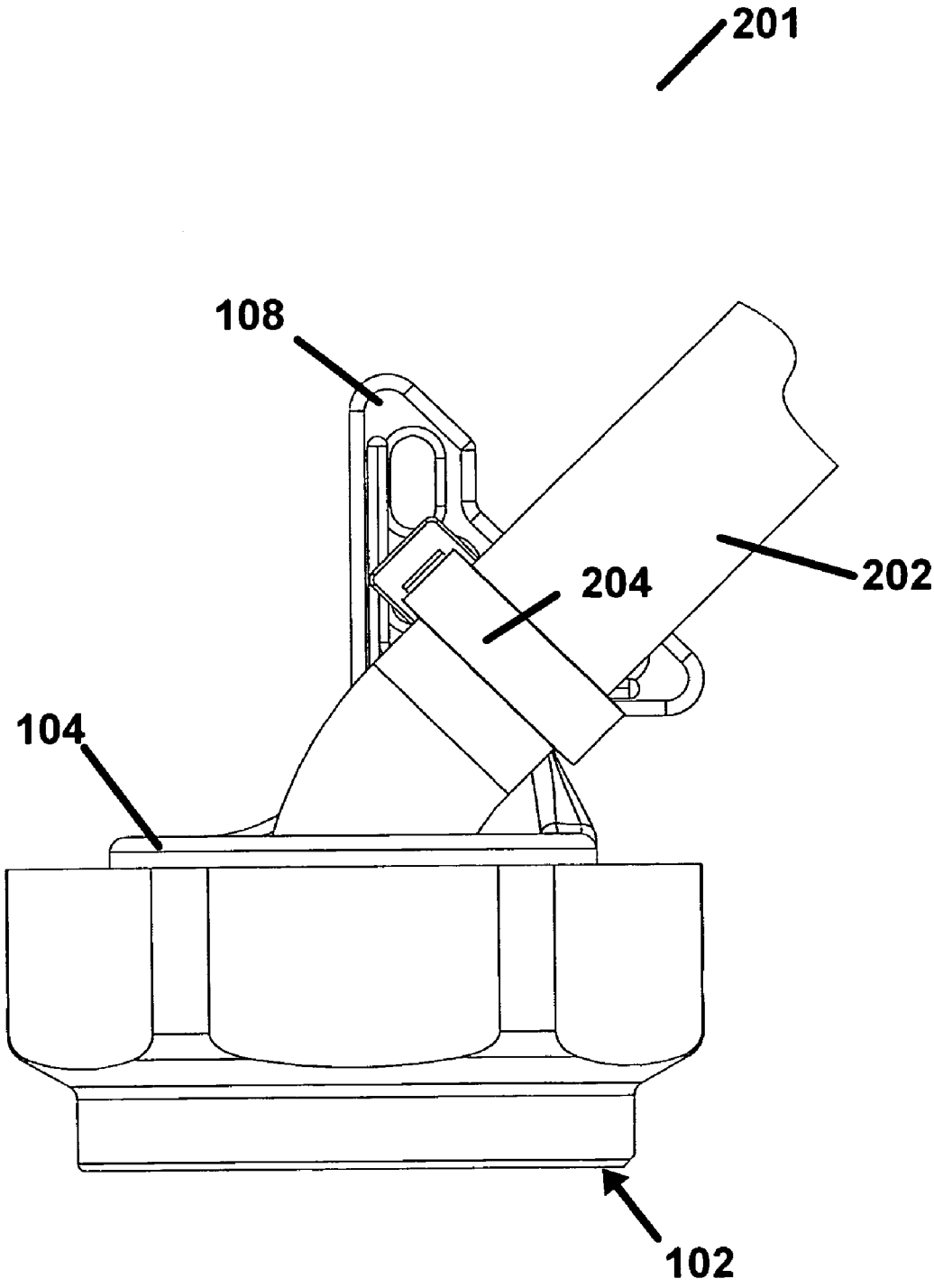
FIG. 2*b* is a side view of a back shell employing a tie wrap to maintain a cable exit angle of approximately 45 degrees, in accordance with an embodiment of the present invention.

FIG. 2*b* is a side view 201 of a back shell 102 employing a tie wrap 204 to maintain a cable exit angle of approximately 45 degrees, in accordance with an embodiment of the present invention. Cable 202 is held in place via tie wrap 204, which extends around cable 202 and through either one or both elongated hole 110*b,c* (not shown).

Figure 2C:
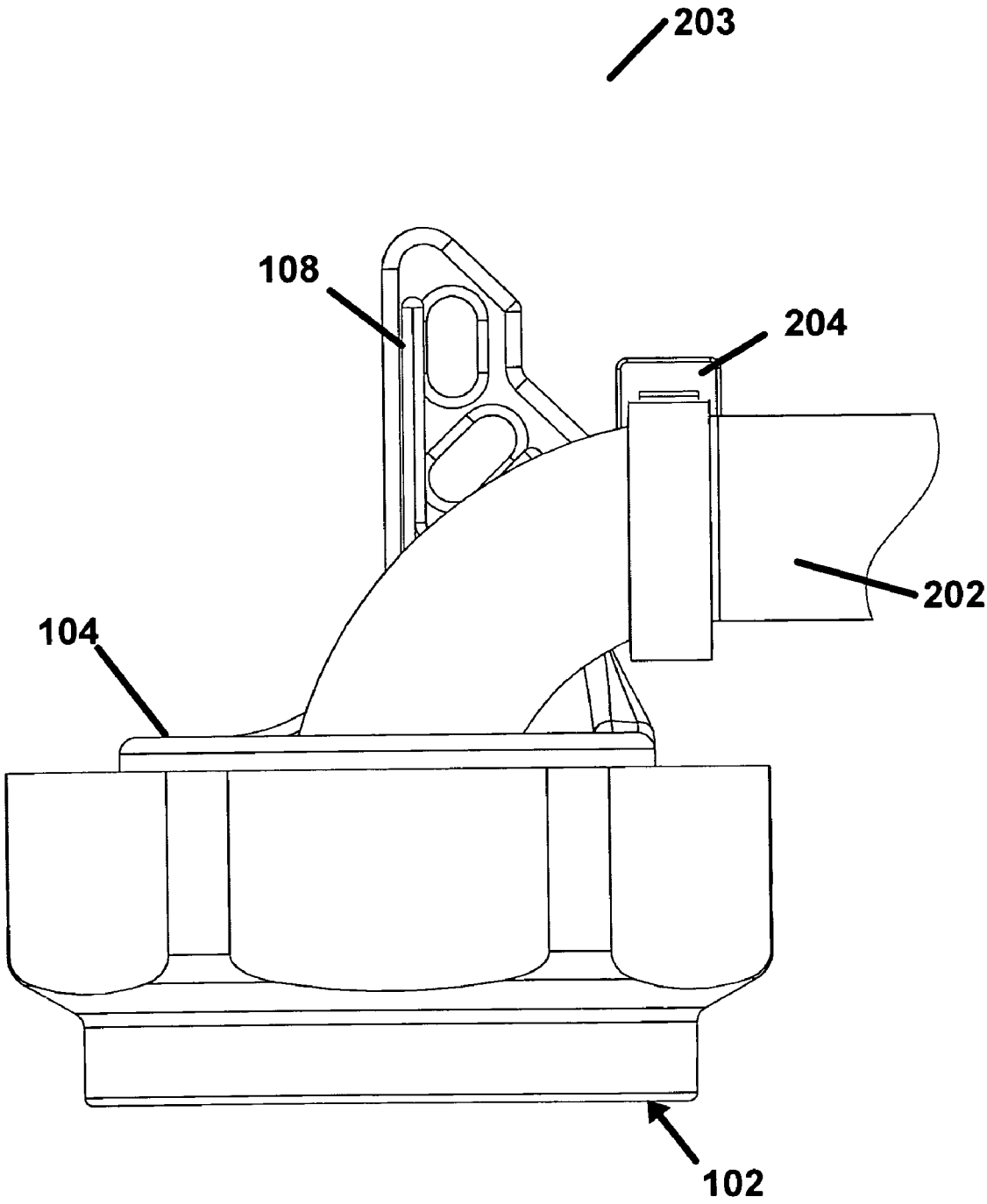
FIG. 2*c* is a side view of a back shell employing a tie wrap to maintain a cable exit angle of approximately 90 degrees, in accordance with an embodiment of the present invention.

FIG. 2*c* is a side view 203 of a back shell 102 employing a tie wrap 204 to maintain a cable exit angle of approximately 90 degrees, in accordance with an embodiment of the present invention. Cable 202 is held in place via tie wrap 204, which extends around cable 202 and through elongated hole 110*d* (not shown).

Figure 3A:
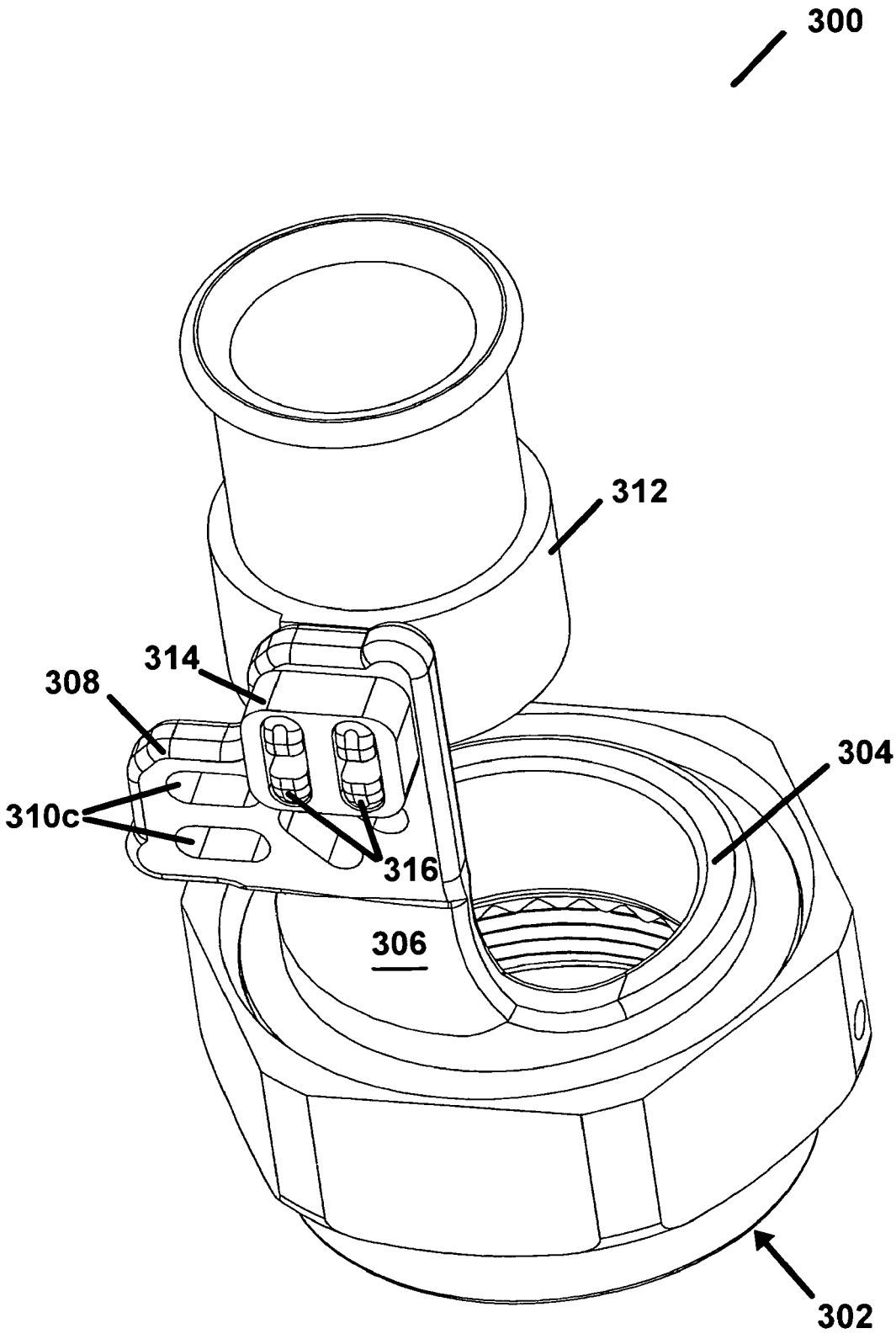
FIG. 3*a* is an isometric view of a back shell employing dual split pins and a retaining collar, to maintain a cable exit angle of approximately 0 degrees, in accordance with an embodiment of the present invention.

FIG. 3*a* is an isometric view 300 of a back shell 302 employing dual split pins 316 and a retaining collar 314, to maintain a cable exit angle of approximately 0 degrees, in accordance with an embodiment of the present invention. Back shell 302 comprises a cylindrically shaped forward section 304, which supports transitional element 308 via connecting element 306. Transitional element 308 has a number of "elongated" holes 310 fashioned therein. These elongated holes 310 provide attachment points for a cable retaining device 312, which provides strain relief and fixes the direction of the wire cable exiting the back shell. The cable retaining device 312 has a pair of elongated pins 316, matching the shape of the elongated holes 310, for fastening the cable retaining device 312 to transitional element 308. The pins 316 are split, having a slot fashioned in the center of the pins. A retaining collar 314 is placed over the ends of pins 316 to ensure a firm connection between cable retaining device 312 and transitional element 308.

Figure 3B:
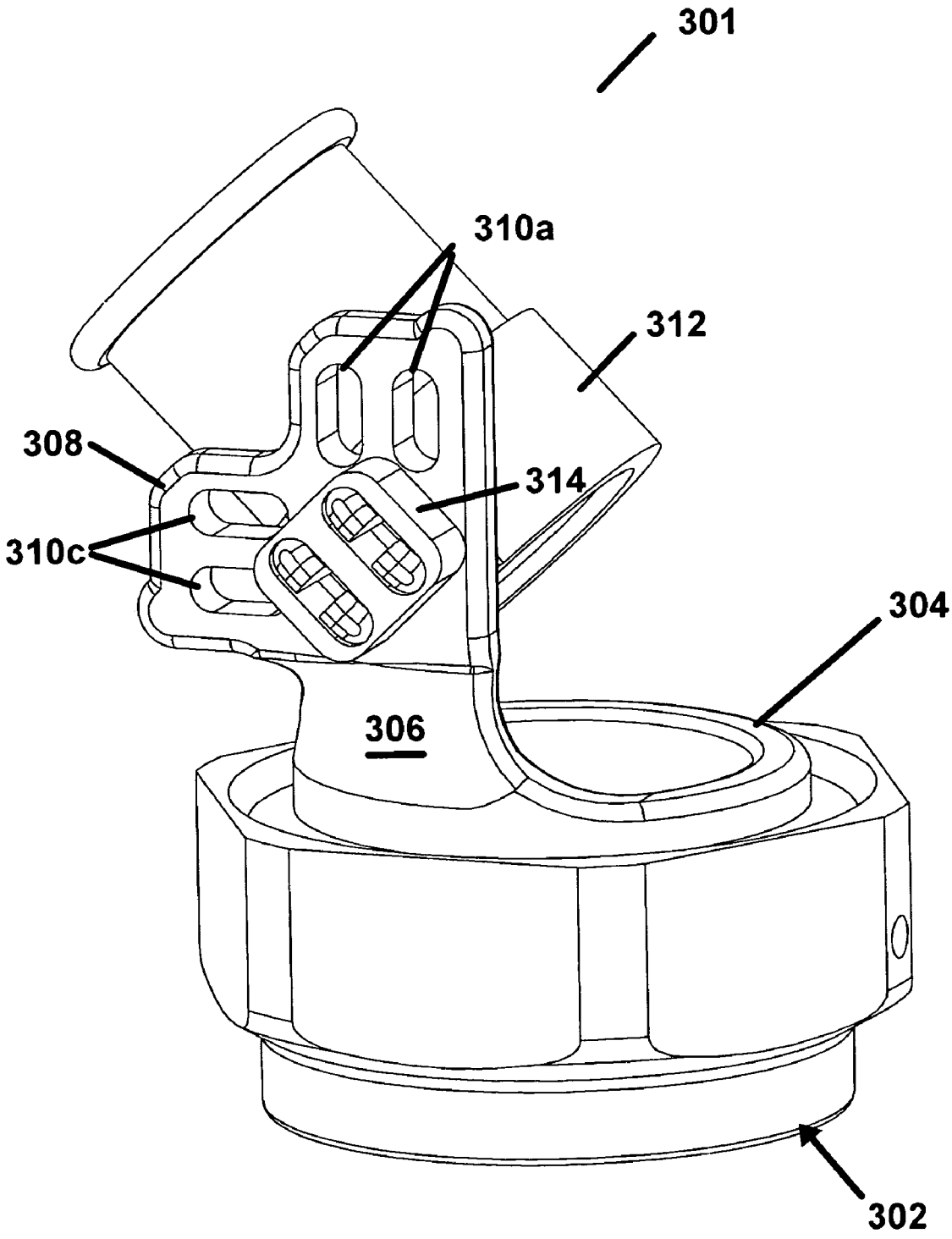
FIG. 3*b* is an isometric view of a back shell employing dual split pins and a retaining collar, to maintain a cable exit angle of approximately 45 degrees, in accordance with an embodiment of the present invention.

FIG. 3*b* is an isometric view 301 of a back shell 302 employing dual split pins and a retaining collar 314, to maintain a cable exit angle of approximately 45 degrees, in accordance with an embodiment of the present invention. Elongated holes 310*a*, 310*c* are unused in this configuration.

Figure 3C:
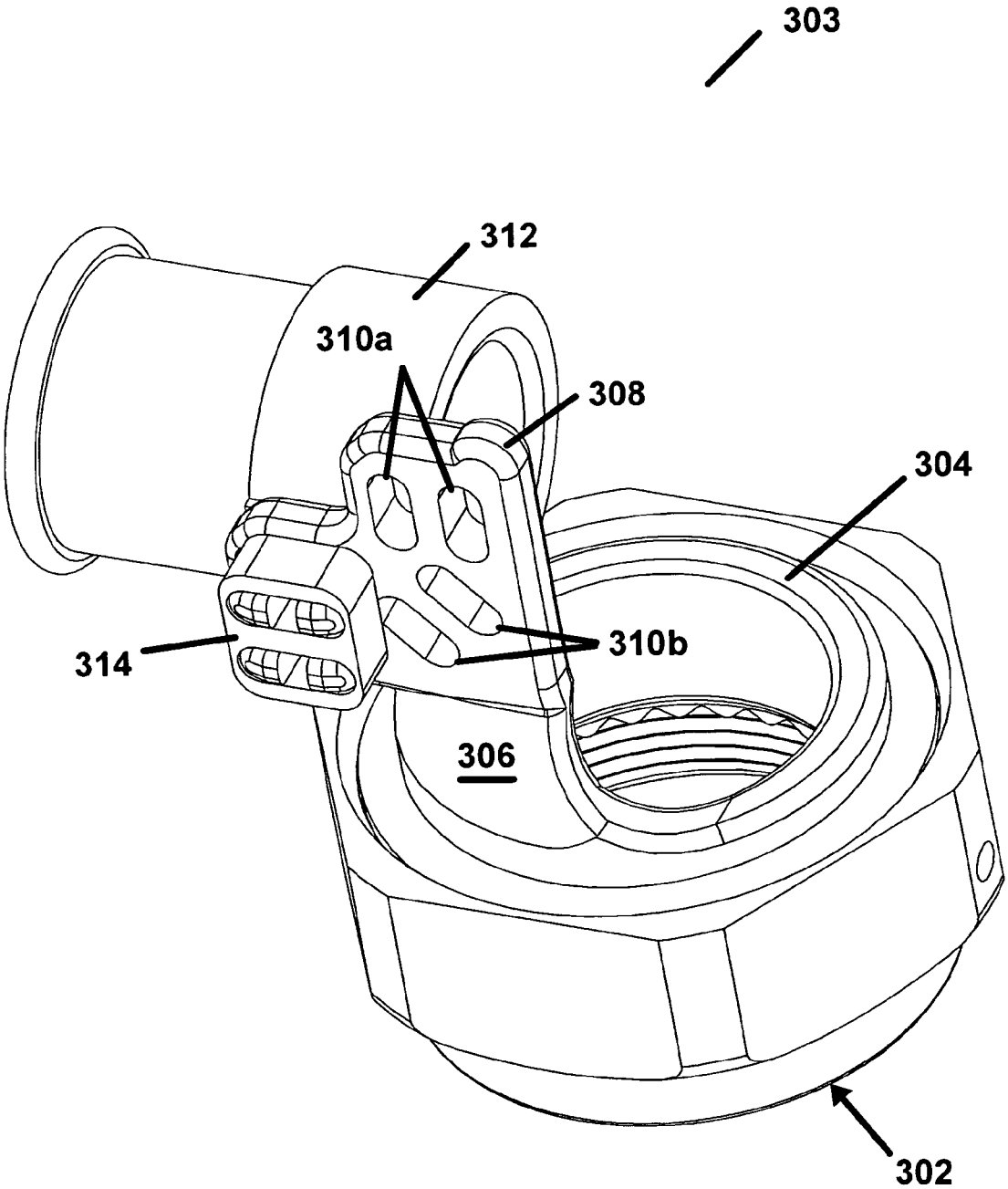
FIG. 3*c* is an isometric view of a back shell employing dual split pins and a retaining collar, to maintain a cable exit angle of approximately 90 degrees, in accordance with an embodiment of the present invention.

FIG. 3*c* is an isometric view 303 of a back shell 302 employing dual split pins and a retaining collar 314, to maintain a cable exit angle of approximately 90 degrees, in accordance with an embodiment of the present invention. Elongated holes 310*a*, 310*b* are unused in this configuration.

Figure 3D:
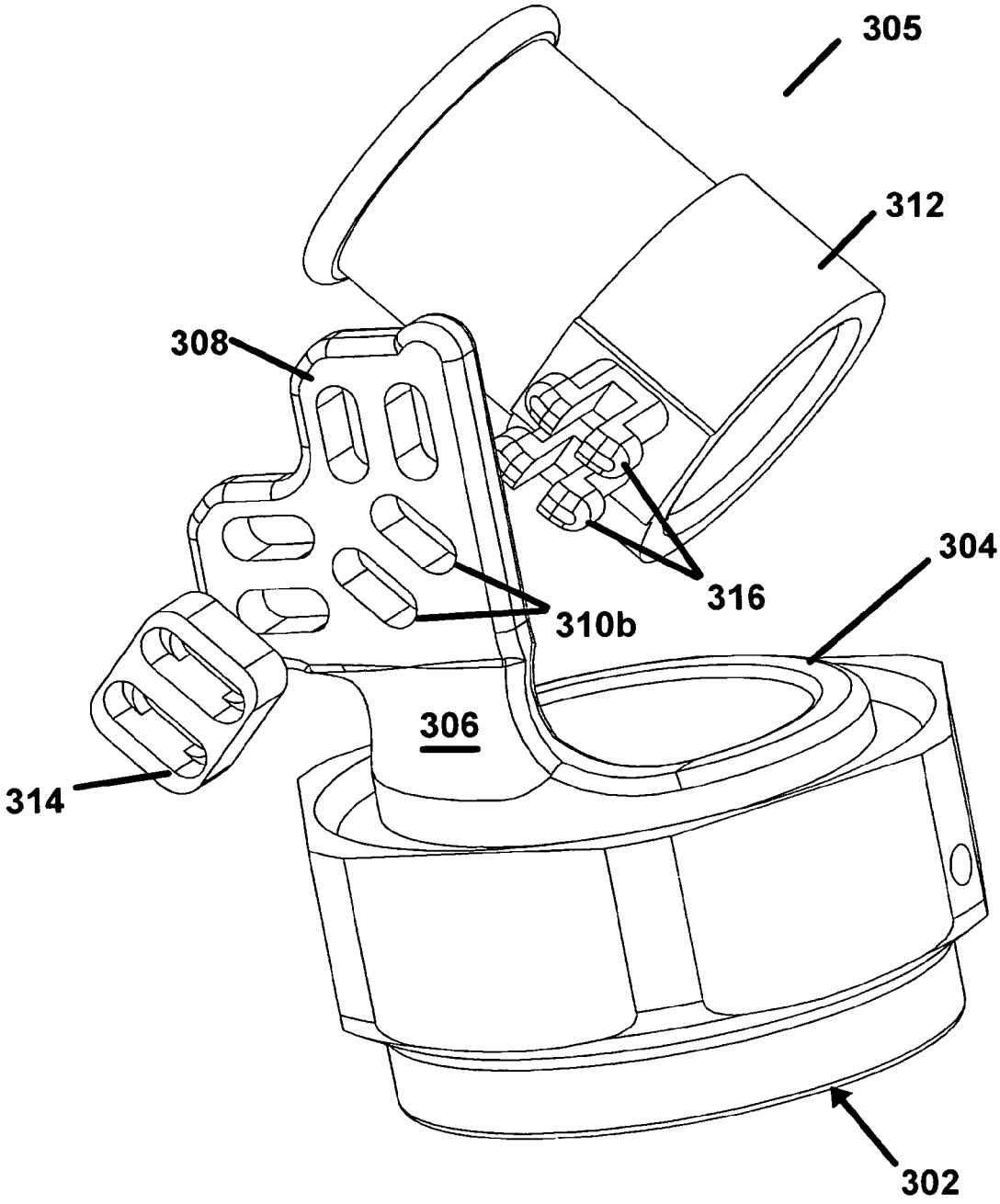
FIG. 3*d* is an isometric exploded assembly view of the back shell of FIG. 3*b*, in accordance with an embodiment of the present invention.
Figure 3E:
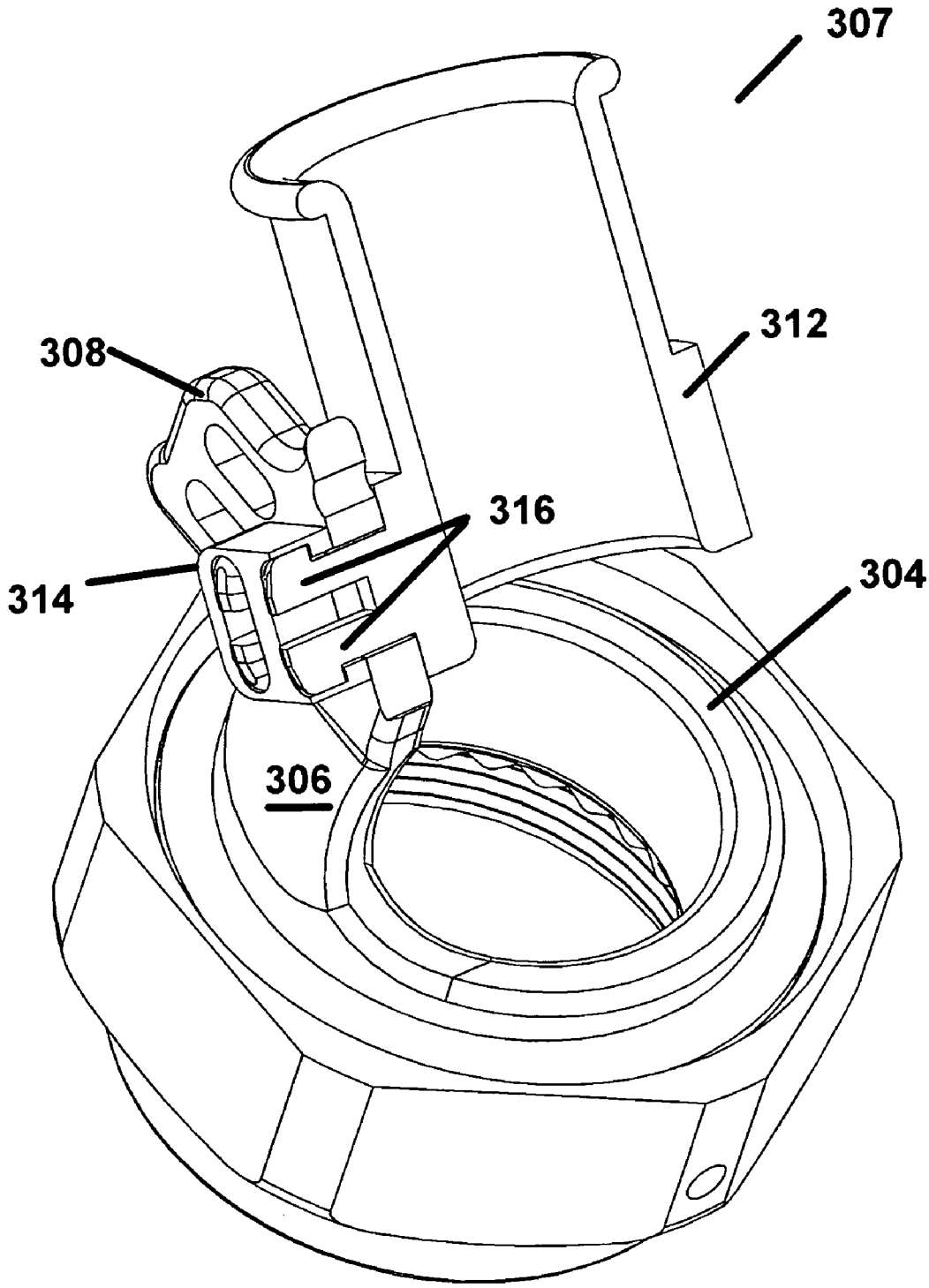
FIG. 3*e* is an isometric, partial cross sectional view of the back shell of FIG. 3*b*, in accordance with an embodiment of the present invention.

FIG. 3*d* is an isometric exploded assembly view 305 of the back shell 302 of FIG. 3*b*, in accordance with an embodiment of the present invention. In this exploded view, the shape of pins 316 is clearly illustrated. Pins 316 have barbed ends that lock with engagement lands formed within locking collar 314. FIG. 3*e* is an isometric, partial cross sectional view 307 of the back shell of FIG. 3*b*. This view illustrates a cut away view of pins 316 engaged with locking collar 314. The locking collar 314 assures a rigid mating of the cable retaining device 312 to the back shell 302, but is also designed to be removable in the field, allowing different cable exit angles to be selected by technicians building the wiring systems in-situ, or by cable harness builders assembling a wiring system with jigs.

Cable retaining device 312 is illustrated as tubular structure having a continuous wall for simplicity. As is well known to those skilled in the art, cable retaining devices may have many other shapes and forms. Each of these may be provided with pins 316 for attachment to the back shell. For example, the tubular section may split in two halves or be hinged (not shown)to allow easy insertion of the cable. Clamps or cable ties may be used to retain the cable. In other embodiments, only a portion of the tubular wall is attached to pins 316, providing a curved plate (not shown) to which the cable is attached using cable ties or tie wraps. Flexible electrical shielding (not shown) may also be added between forward section 310 cable retainer 312. This shielding will allow the cable retainer to be mounted for various exit angles while maintaining electrical shield integrity of the back shell assembly.

Figures 3F, 3H:
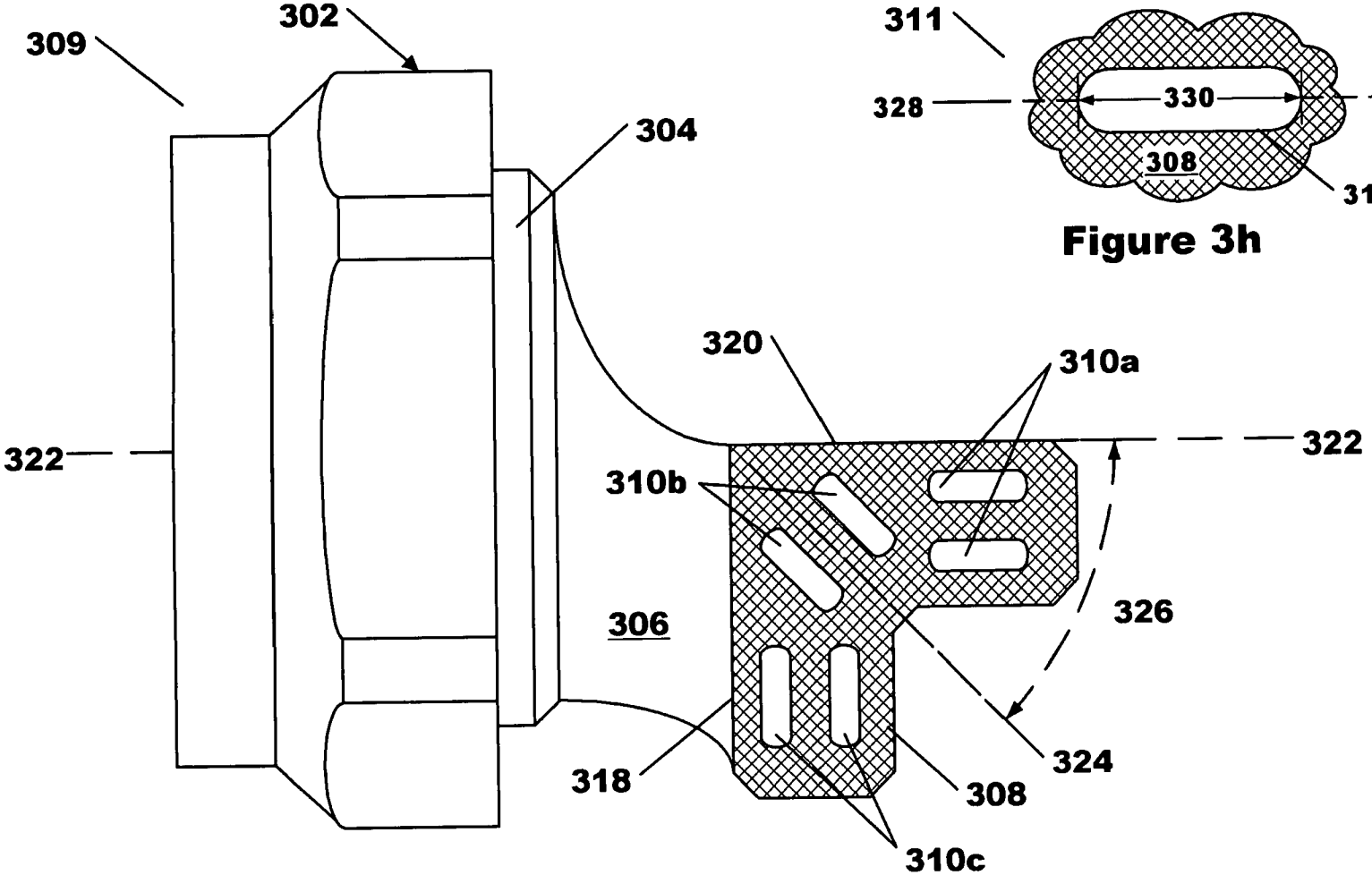
FIG. 3*f* is a side view of the back shells of FIGS. 3*a*-3*e*, in accordance with an embodiment of the present invention.
FIG. 3*h* is an expanded side view of the elongated holes 310 of FIG. 3*f*, in accordance with an embodiment of the present invention.

FIG. 3*f* is a side view 309 of the back shells 302 of FIGS. 3*a*-3*e*, in accordance with an embodiment of the present invention. Transitional element 308 is cross hatched for clarification of its geometric boundaries and properties. Cylindrically shaped forward section 304 defines an axis of symmetry 322 through the center of the back shell 302. Transitional element 308 is bounded by two orthogonal edges 318 and 320. Edge 320 is parallel to axis 322. Edge 318 is orthogonal to edge 320 (and axis 322), and provides the connection interface to connecting element 306. Angle 326, defined by axis 324, resides within the angle formed by the intersection of edges 318 and 320, and ranges from 0 to 90 degrees. Preferably, angle 326 bisects the angle between the angle formed by the intersection of edges 318 and 320, and is approximately 45 degrees. Elongated hole pairs 310*a*-310*c* are fashioned within transitional element 318. Elongated hole pair 310*a* are placed with their longest dimension parallel to edge 320 and axis 322. Elongated hole pair 310*c* have their longest dimension parallel to edge 318, or perpendicular to edge 320 and axis 322. Elongated hole pair 310*b* are oriented with their longest dimension parallel to axis 324. FIG. 3*h* is an expanded side view 311 of the elongated holes 310 of FIG. 3*f*. The length 330 of hole 310 is greater than the width, with axis 328 is parallel to the direction of the longest dimension.

Figure 4A:
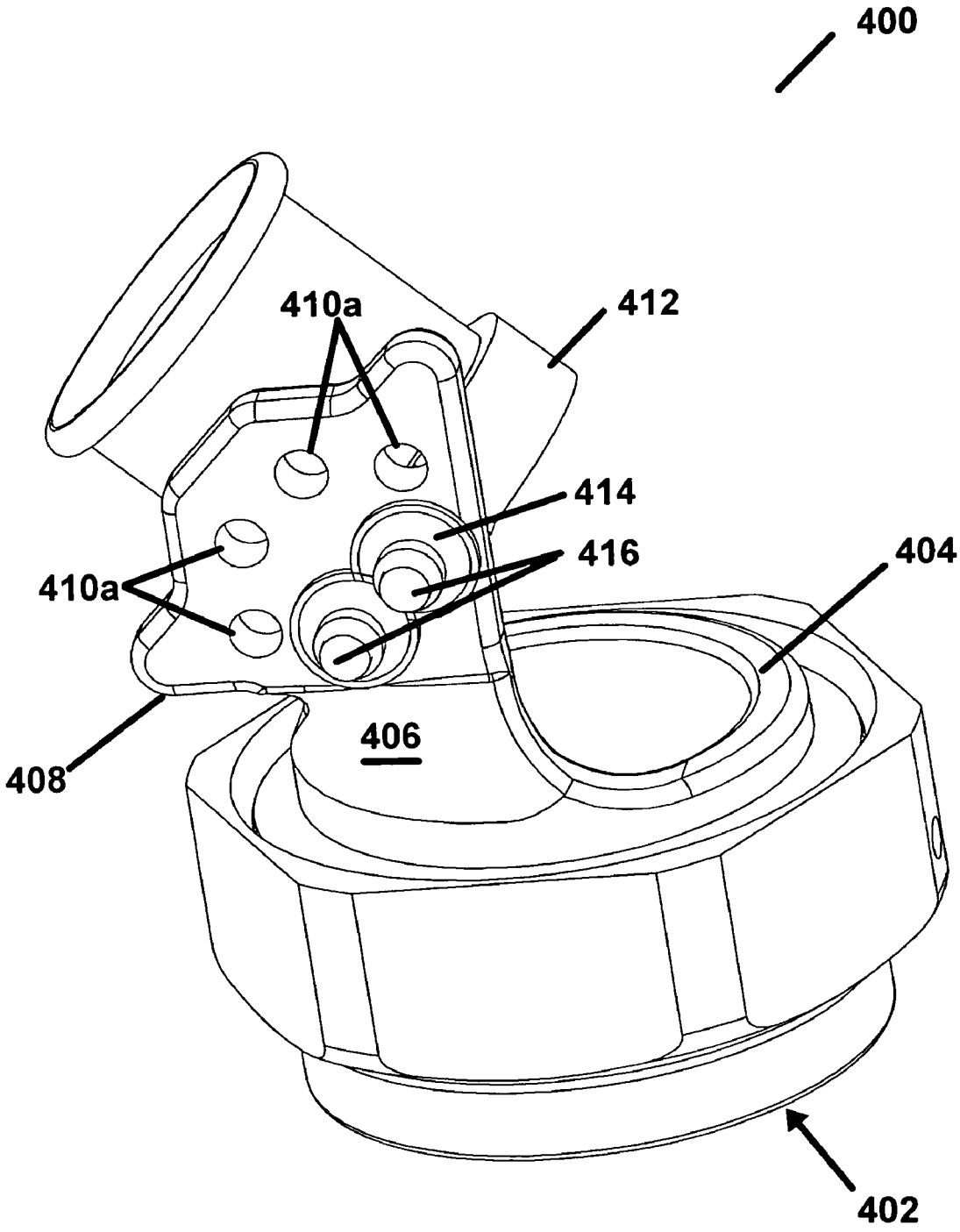
FIG. 4*a* is an isometric view of a back shell employing dual cylindrical pins and a retaining collar, to maintain a cable exit angle of approximately 45 degrees, in accordance with an embodiment of the present invention.

FIG. 4*a* is an isometric view 400 of a back shell 402 employing dual cylindrical pins 416 and a retaining collar 414, to maintain a cable exit angle of approximately 45 degrees, in accordance with an embodiment of the present invention. Back shell 402 comprises a cylindrically shaped forward section 404, which supports transitional element 408 via connecting element 406. Transitional element 408 has a number of circular shaped holes 410 fashioned therein. These holes 410 provide attachment points for a cable retaining device 412, which provides strain relief and fixes the direction of the wire cable exiting the back shell. The cable retaining device 412 has a pair of circular shaped pins 416, matching the shape of the holes 410, for fastening the cable retaining device 412 to transitional element 408. A retaining collar 414 is placed over the ends of pins 416 to ensure a firm connection between cable retaining device 412 and transitional element 408.

Figure 4B:
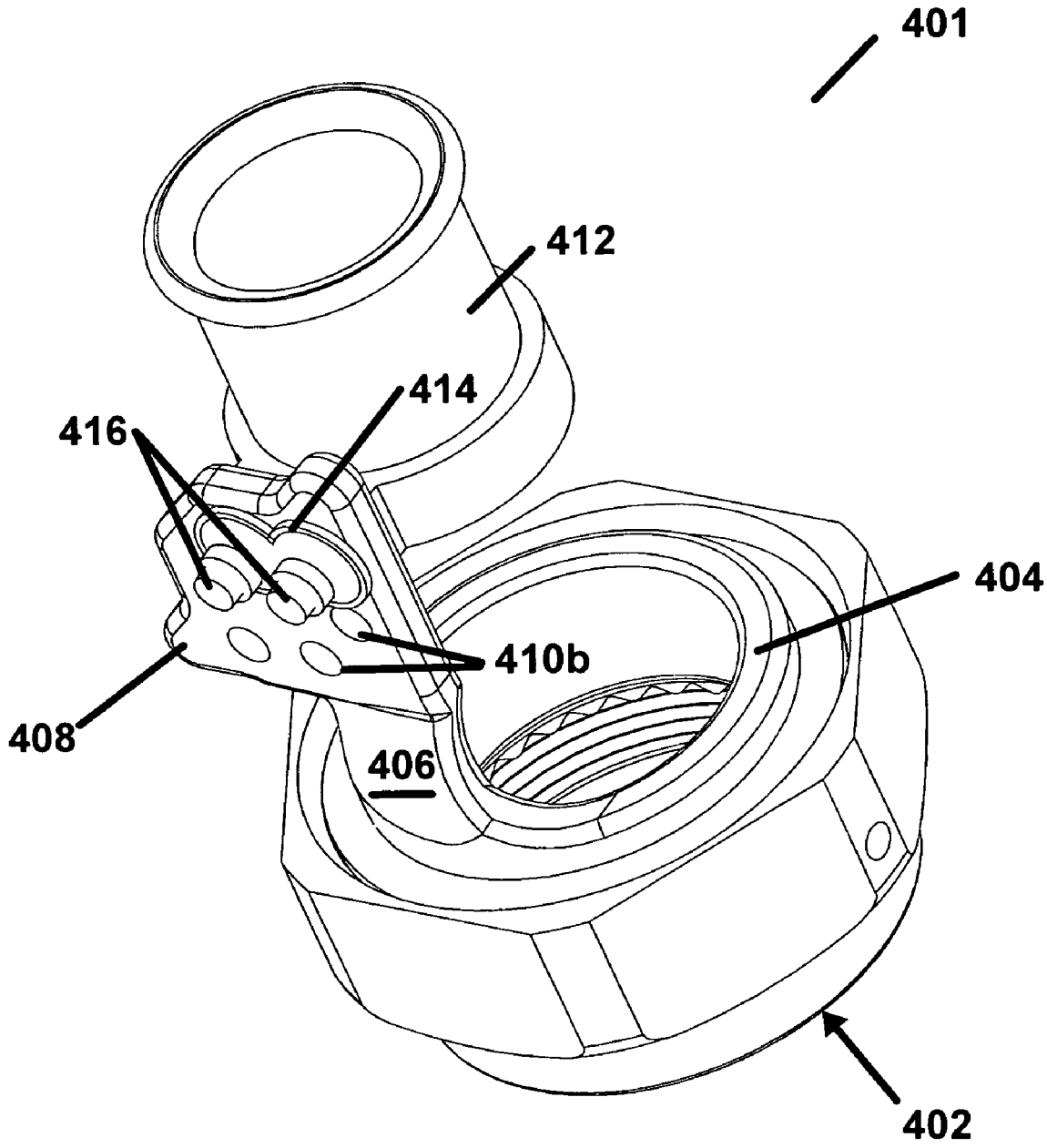
FIG. 4*b* is an isometric view of a back shell employing dual cylindrical pins and a retaining collar, to maintain a cable exit angle of approximately 0 degrees, in accordance with an embodiment of the present invention.

FIG. 4*b* is an isometric view 401 of a back shell 402 employing dual cylindrical pins 416 and a retaining collar 414, to maintain a cable exit angle of approximately 0 degrees, in accordance with an embodiment of the present invention.

Figure 4C:
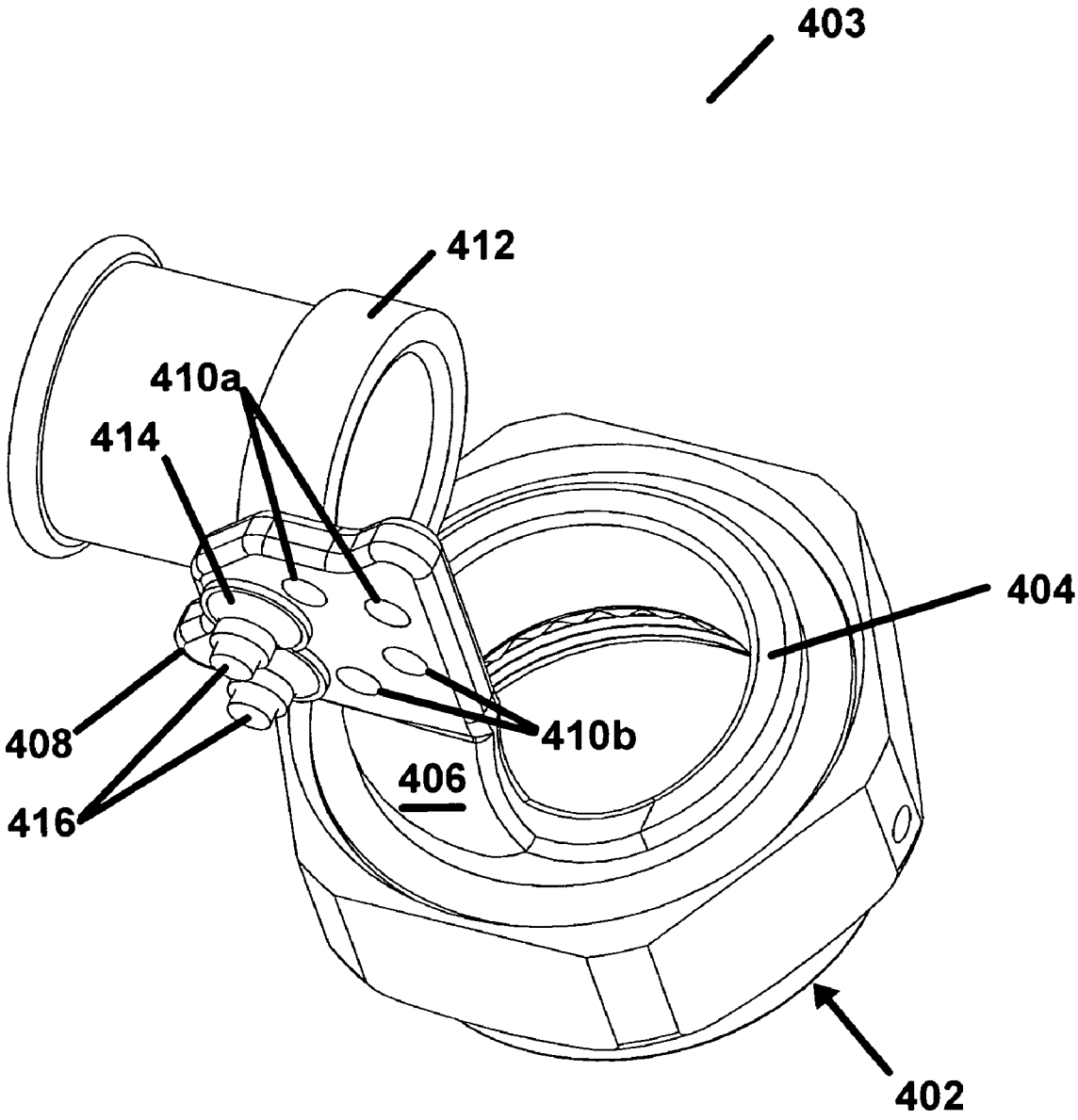
FIG. 4*c* is an isometric view of a back shell employing dual cylindrical pins and a retaining collar, to maintain a cable exit angle of approximately 90 degrees, in accordance with an embodiment of the present invention.

FIG. 4*c* is an isometric view 403 of a back shell 402 employing dual cylindrical pins 416 and a retaining collar 414, to maintain a cable exit angle of approximately 90 degrees, in accordance with an embodiment of the present invention.

The present invention is not limited by the previous embodiments heretofore described. Rather, the scope of the present invention is to be defined by these descriptions taken together with the attached claims and their equivalents.

What is claimed is:

1. A connector back shell, said connector back shell operative to provide support for a wiring cable attached to a wiring connector, said connector back shell comprising:

a forward section having a hollow cylindrical shape, said cylindrical shape defining a first axis, said forward section operative to couple said connector back shell to said wiring connector;

a transitional element, said transitional element comprising a plate having a first terminating straight edge, said first terminating straight edge positioned approximately parallel to said first axis, said plate having a second terminating straight edge, said second terminating straight edge positioned approximately perpendicular to said first straight edge;

a connecting element, said connecting element operative to rigidly couple said transitional element to said forward section, said connecting element rigidly fixed to said transitional element along a portion of said second terminating straight edge of said plate; and a cable retaining device, said cable retaining device attached to said plate of said transitional element, said cable retaining device operative to position said wiring cable relative to a first angle.

2. The connector back shell as recited in claim 1, wherein said plate of said transitional element comprises a plurality of holes fashioned therein, said plurality of holes located in a pattern, said pattern symmetric about a second axis, said second axis defined by bisection of a second angle formed by said first and said second terminating straight edges of said plate.

3. The connector back shell as recited in claim 2, wherein said plurality of holes comprise elongated holes, said elongated holes having a length greater than a width.

4. The connector back shell as recited in claim 3, wherein said plurality of elongated holes comprise:

a first group of elongated holes, said first group oriented such that said length of said elongated holes are parallel to said second axis;

a second group of elongated holes, said second group oriented such that said length of said elongated holes are parallel to said first terminating straight edge of said plate; and a third group of elongated holes, said third group oriented such that said length of said elongated holes are perpendicular to said first terminating straight edge of said plate.

5. The connector back shell as recited in claim 4, wherein said first group of elongated holes comprise two elongated holes.

6. The connector back shell as recited in claim 4, wherein said second and said third groups of elongated holes each comprise one or more elongated holes.

7. The connector back shell as recited in claim 6, wherein said second and said third groups of elongated holes each comprise two elongated holes.

8. The connector back shell as recited in claim 4, wherein said cable retaining device comprises a plurality of pins operative to orient said wiring cable to said first angle of approximately 45 degrees when at least one pin of said plurality of pins are inserted in said first group of elongated holes.

9. The connector back shell as recited in claim 8, wherein said cable retaining device is held in position by clips, said clips inserted over ends of at least one pin of said plurality of pins, subsequent to insertion of said at least one pin of said plurality of pins into said first group of elongated holes.

10. The connector back shell as recited in claim 4, wherein said cable retaining device comprises a plurality of pins operative to orient said wiring cable to said first angle of approximately 0 degrees relative to said first axis, when at least one pin of said plurality of pins are inserted in said second group of elongated holes.

11. The connector back shell as recited in claim 10, wherein said cable retaining device is held in position by clips, said clips inserted over ends of at least one pin of said plurality of pins, subsequent to insertion of said at least one pin of said plurality of pins in said first group of elongated holes.

12. The connector back shell as recited in claim 4, wherein said cable retaining device comprises a plurality of pins operative to orient said wiring cable to said first angle of approximately 90 degrees relative to said first axis, when at least one pin of said plurality of pins are inserted in said third group of elongated holes.

13. The connector back shell as recited in claim 12, wherein said cable retaining device is held in position by clips, said clips inserted over ends of at least one pin of said plurality of pins, subsequent to insertion of said at least one pin of said plurality of pins in said first group of elongated holes.

14. A connector back shell, said connector back shell operative to provide support for a wiring cable attached to a wiring connector, said connector back shell comprising:

a forward section having a hollow cylindrical shape, said cylindrical shape defining a first axis, said forward section operative to couple said connector back shell to said wiring connector;

a transitional element, said transitional element comprising a plate having a first terminating straight edge, said first terminating straight edge positioned approximately parallel to said first axis, said plate having a second terminating straight edge, said second straight edge positioned approximately perpendicular to said first terminating straight edge, said plate of said transitional element having a plurality of holes fashioned therein, said plurality of holes located in a pattern, said pattern symmetric about a second axis, said second axis defined by bisection of a second angle formed by said first and said second straight edges of said plate;

a connecting element, said connecting element operative to rigidly couple said transitional element to said forward section, said connecting element rigidly fixed to a portion of said second terminating straight edge of said plate; and a cable retaining device, said cable retaining device attached to said plate of said transitional element, said cable retaining device operative to position said wiring cable relative to a first angle.

15. The connector back shell as recited in claim 14, wherein said plurality of holes comprise elongated holes, said elongated holes having a length greater than a width.

16. The connector back shell as recited in claim 15, wherein said plurality of elongated holes comprise:

a first group of elongated holes, said first group oriented such that said length of said elongated holes are parallel to said second axis;

a second group of elongated holes, said second group oriented such that said length of said elongated holes are parallel to said first terminating straight edge of said plate; and a third group of elongated holes, said third group oriented such that said length of said elongated holes are perpendicular to said first terminating straight edge of said plate.

17. The connector back shell as recited in claim 16, wherein said first group of elongated holes comprise two elongated holes.

18. The connector back shell as recited in claim 16, wherein said second and said third groups of elongated holes each comprise one or more elongated holes.

19. The connector back shell as recited in claim 18, wherein said second and said third groups of elongated holes each comprise two elongated holes.

20. The connector back shell as recited in claim 16, wherein said cable retaining device comprises a plurality of pins operative to orient said wiring cable to said first angle of approximately 45 degrees when at least one pin of said plurality of pins are inserted in said first group of elongated holes.

* * * * *